US009944359B2

(12) United States Patent
Grall

(10) Patent No.: US 9,944,359 B2
(45) Date of Patent: Apr. 17, 2018

(54) SYSTEM COMPRISING A DEAD WEIGHT AND EQUIPMENT ON A TROLLING LINE HAVING AUTOMATED RELEASES AND RETRIEVALS AND IMPLEMENTATION METHOD

(71) Applicant: IXBLUE, Saint-Germain-en-Laye (FR)

(72) Inventor: Sebastien Grall, Aubagne (FR)

(73) Assignee: IXBLUE, Saint-Germain-en-Laye (FR)

( * ) Notice: Subject to any disclaimer, the term of this patent is extended or adjusted under 35 U.S.C. 154(b) by 0 days.

(21) Appl. No.: 15/301,029

(22) PCT Filed: Mar. 31, 2015

(86) PCT No.: PCT/FR2015/050827

§ 371 (c)(1),
(2) Date: Sep. 30, 2016

(87) PCT Pub. No.: WO2015/150688

PCT Pub. Date: Oct. 8, 2015

(65) Prior Publication Data

US 2017/0029077 A1 Feb. 2, 2017

(30) Foreign Application Priority Data

Apr. 1, 2014 (FR) ..... 14 52889

(51) Int. Cl.
*B63B 21/58* (2006.01)
*B63B 21/66* (2006.01)
(Continued)

(52) U.S. Cl.
CPC ..... *B63B 21/66* (2013.01); *B63G 8/42* (2013.01); *B63B 21/16* (2013.01); *B63B 2027/165* (2013.01)

(58) Field of Classification Search
CPC ..... B63B 21/66; B63B 21/16; B63G 8/42
See application file for complete search history.

(56) References Cited

U.S. PATENT DOCUMENTS 8,104,419 B2 * 1/2012 Coupeaud ..... B63B 21/66 114/253
2010/0064955 A1 3/2010 Coupeaud et al.

FOREIGN PATENT DOCUMENTS

EP 0 877 262 A2 11/1998
WO 2008/043823 A1 4/2008

OTHER PUBLICATIONS

International Search Report, dated Jun. 30, 2015, from corresponding PCT application.

* cited by examiner

*Primary Examiner* — Stephen P Avila
(74) *Attorney, Agent, or Firm* — Young & Thompson

(57) ABSTRACT

System including a dead weight and equipment on a trolling line released from and retrieved to a receiving structure of a vessel, the dead weight including a controllable element for blocking and unblocking the line, so as to immobilize the line relative to the dead weight in the blocked configuration, and to allow the line to run relative to the dead weight in the unblocked configuration; a first detection element for detecting whether or not or not the equipment has moved to a predefined distance from the dead weight; a control element configured, in case of an order to release: —in a step 2L, to release the equipment from the structure, —in a step 3L, when the first detection element detects the equipment has moved to the predefined distance, to then release the dead weight and control the blocking and unblocking element to shift to the blocked configuration.

9 Claims, 5 Drawing Sheets

(51) Int. Cl.

| | |
|---|---|
| ***B63G 8/42*** | (2006.01) |
| *B63B 27/16* | (2006.01) |
| *B63B 21/16* | (2006.01) |

SYSTEM COMPRISING A DEAD WEIGHT AND EQUIPMENT ON A TROLLING LINE HAVING AUTOMATED RELEASES AND RETRIEVALS AND IMPLEMENTATION METHOD

The present invention relates to a system of dead weight and equipment on an automatic launch and retrieval trolling line. The technical field related to by the invention is the exploration of seas and water areas. More specifically, the handling of towed measurement devices and the apparel required for the handling thereof.

BACKGROUND OF THE INVENTION

During the towing of certain measurement devices towed by the ships, sometimes called "fishes" but generally called herein "equipment", as for example sonars, elements called "dead weight" or "V fin" are to be used. Such equipment and dead weights are towed by means of winches and towing cables, herein called trolling line, ensuring the mechanical link as well as, the most often, the transfer of data and/or energy between the ship and the equipment.

These dead weights are generally used for reasons of stability and immersion and the dead weight is interposed between the equipment and the ship. This dead weight has for main functions the decoupling of the ship movements with respect to the equipment and the equipment immersion control. These dead weights may use gravity or hydrodynamics or both at a time to play their role.

A method commonly used to handle the equipment and the dead weight consists in anchoring the equipment at the end of the trolling line, then anchoring the dead weight on the same line at a variable distance, chosen by the user.

The launch with immersion in water is made either through a crane or through a gantry crane, in the following manner:

- immersing the equipment,
- unwinding the trolling line up to the place where the dead weight must be anchored to the trolling line,
- immersing the dead weight,
- continuing the unwinding of the line up to the wanted distance of positioning of the equipment with respect to the towing ship.

The equipment may then be used.

The exit from water of the trailed/towed elements for their retrieval is made in the same manner but in the opposite order.

It is also known from the document W02008/043823 a device for the automatic anchoring and disanchoring of a fish (sonar emitter) along a trolling line with automatic passive immobilization of the fish with respect to the line and the passive locking thereof to the line.

These launch and retrieval operations have difficulties and dangers requiring staff on an adapted working platform of the ship. The handled elements are heavy and the ship is on motion (pitch, roll . . . ). The cable must be able to pass in at least one pulley or in any device fulfilling this role. Most often, this pulley is fixed to a gantry crane, or even a crane, which allows at the time of launch, bringing the equipment above the water before releasing/unwinding the line by means of a winch, in order to place the equipment in water. From then on, once the equipment in water, it becomes difficult to retrieve the line to anchor the dead weight thereto.

This is also true at the time of retrieval of trailed/towed elements. Hence risks for the staff and for the equipment that is sometimes fragile.

SUMMARY OF THE INVENTION

In this context, the invention relates in particular the handling and the automatic immobilization of the dead weight in a storage position at the time of retrieval by picking the trailed/towed elements back on board, and reversely, for the automatic release of the dead weight during the launch of the elements intended to be trailed/towed. The automatization concerning the immobilization and the release of the dead weight is preferably obtained by essentially mechanical means. In more evolved modes, this is the whole of the equipment, dead weight and trolling line launch and retrieval operations that is automated.

Hence, the invention relates to a system of dead weight and equipment on a trolling line with launch and retrieval from a receiving structure of a machine navigating on or in water, the trolling line being continuous and integral with the equipment, the dead weight and the receiving structure and including a first end on the equipment side and a second end on the receiving structure side, the equipment being fixed in a fixed point of the line, preferably at the first end of the line, the line on the second end side being fixed to the receiving structure in a point that is mobile over its length so as to allow the launch or the retrieval of said line, of the equipment and of the dead weight, wherein, at the operational state, said equipment and said dead weight having been launched by unreeling of the trolling line, we find in water, successively: the equipment, a first portion of line of a first determined length, the dead weight, a second portion of line of a second determined length and the receiving structure, and wherein, at the rest state, said equipment, said dead weight and said line are on or in the receiving structure after a retrieval of the line on or in the receiving structure.

According to the invention, the system includes:

- a controllable arrangement for locking and unlocking the dead weight on the line making it possible, in a locking configuration, to immobilize the line with respect to the dead weight and, in an unlocking configuration, to permit the line to slide with respect to the dead weight, the line then remaining linked to the dead weight but being slidingly mobile with respect to the latter,
- a first detection device making it possible to detect whether or not the equipment has moved away to a determined distance from the dead weight and corresponding to the first determined length of the first portion of line,
- a control means configured so as, in case of an order to launch from the rest state, to successively:
  - at a step of equipment launch 2L, launch the equipment out of the receiving structure by unwinding of the line,
  - at a step of dead weight launch 3L, when the first detection device detects that the equipment has moved away to the first determined distance from the dead weight, launch said dead weight and control the locking and unlocking arrangement to the locking configuration while continuing to unreel the line, the line being then immobilized with respect to the dead weight,
  - at a step of unwinding stop 4L, stop the line unreeling when the unwinding of the line has allowed obtaining the second determined length of the second line portion.

In various embodiments of the invention, the following means, which can be used alone
or in any technically possible combination, are used:

the system is intended to troll sonar equipment in marine environment, the launch and retrieval operations are performed from one/on the receiving structure of the navigating machine, the launch and retrieval operations are performed from one/in the receiving structure of the navigating machine, the control means is further configured so as, at a step 1L of the launch preceding step 2L, to control the locking and unlocking arrangement to the unlocking configuration if it wasn't in it, preferably, the locking and unlocking arrangement is in the locking configuration only when the dead weight is launched, i.e. released from the receiving structure or from the catching device thereof according to the case, the locking and unlocking arrangement is in the dead weight, the first detection device is in the dead weight, the receiving structure includes a gantry crane or a launching crane, for the equipment launch, the control means is configured so as to operate the gantry crane or the crane in order to place the equipment in position to accede to the immersion in water and the trolling line is unreeled, the system includes a second detection device making it possible to detect whether or not the dead weight is on or in the reception structure and, at the step of dead weight launch, the control of the locking and unlocking arrangement to the locking configuration results from the detection by the second detection device that the dead weight is not on or in the receiving structure after the launch of said dead weight, the second detection device is in the dead weight, the control means is further configured so as, in case of an order to retrieve, the system being at the operational state, to successively:

at a step 1R of the retrieval, retrieve the line on the receiving structure, at a step 2R, when the second detection device detects that the dead weight has been retrieved on or in the receiving structure, then control the locking and unlocking arrangement to the unlocking configuration and continue to retrieve the line on the receiving structure, the line being then able to slide with respect to the dead weight, the system includes a third detection device that makes it possible to detect whether or not the equipment has moved closer, to a determined distance of docking of the dead weight, said determined distance of docking being lower than the length of the first portion of line and corresponding to a reduced length of line between the equipment and the dead weight allowing the equipment to be handled on or in the receiving structure, and the control means is further configured so as, in case of an order to retrieve, the system being at the operational state, to successively:

at a step of line retrieval 1R, partially retrieve the line 6 on the receiving structure, at a step of dead weight retrieval 2R, when the second detection device detects that the dead weight has been retrieved on or in the receiving structure, control the locking and unlocking arrangement to the unlocking configuration and continue to retrieve the line on the receiving structure, the line being able to slide with respect to the dead weight, at a step of equipment retrieval 3R, when the third detection device detects that the equipment has moved closer, to the determined distance of docking of the dead weight, handle the equipment on the receiving structure and stop the reeling of the line, the reduced length of line between the equipment and the dead weight allowing the equipment to be handled on or in the receiving structure is a practically null length, the equipment being in contact with the dead weight, the dead weight includes an equipment docking guide, the control means is further configured so as, in case of an order to retrieve and after step 3R, to, at a step 4R, control the locking and unlocking arrangement to the locking configuration, the system further includes a controllable member for immobilizing and releasing the dead weight on/from the receiving structure, so as, in an immobilization configuration, to lock the dead weight on or in the receiving structure and, in a release configuration, to release the dead weight in order to allow it to leave the receiving structure, and the control means is further configured so as, when in case of an order to launch the first detection device detects that the equipment has moved away to the first determined distance from the dead weight, to then control the immobilization and release member to the release configuration so as to launch said dead weight, and the immobilization configuration is the configuration by default of the immobilization and release member, the retrieval of the dead weight on or in the receiving structure causing by default the immobilization of the dead weight, the immobilization and release member is in the dead weight, the system further includes a controllable means for holding and relieving the equipment on or in/from the receiving structure, in the holding configuration, said means allowing the equipment to be locked on the receiving structure and, in the relieving configuration, the equipment being free to leave the receiving structure, and the control means is further configured, on the one hand, in case of order to launch and before the equipment launch, to control the holding and relieving means to the relieving configuration, if it wasn't in it, and on the other hand, in case of an order to retrieve and once the equipment retrieved on the receiving structure, to control the holding and relieving means to the holding configuration, the locking and unlocking of the line with respect to the dead weight are automated through essentially mechanical means, the immobilization and the release of the dead weight from the receiving structure, or in a variant, from the catching device, are automated through essentially mechanical means, in the dead weight, the essentially mechanical, controllable line locking and unlocking arrangement, the essentially mechanical, controllable dead weight immobilization and release member, the essentially mechanical, first detection device making it possible to detect whether or not the equipment has moved away to a determined distance from the dead weight corresponding to the first determined length of the first portion of line, the essentially mechanical, second detection device making it possible to detect whether or not the dead weight is on or in the receiving structure, are configured together for an automatic operation with no human intervention, the first detection device is chosen among the following devices:

a mechanical device, a physical marker of particular shape or size arranged at a fixed point on the line, in such a position along the line that the first determined length of the first portion of line is found between the equipment and said fixed point of the physical marker, a sensing pin of the dead weight detecting the presence of said physical marker, a magnetic device, a magnet arranged at a fixed point on the line, in such a position along the line that the first determined length of the first portion of line is found between the equipment and said fixed point of the magnet, a magnetic sensor of the dead weight detecting the presence of said magnet, an optical device, an optical marker arranged at a fixed point on the line, in such a position along the line that the first determined length of the first portion of line is found between the equipment and said fixed point of the optical marker, an optical sensor of the dead weight detecting the presence of said optical marker, a circulating line measurement device giving the length of the line having circulated in both directions of circulation corresponding to the unwinding and to the retrieval of the line with respect to a determined fixed point, said fixed point being either in the dead weight, or in the line unwinding or retrieval apparatus of the receiving structure, a means for comparison with length thresholds making it possible to produce the detections of the first detection device as a function of said thresholds, the second detection device is chosen among the following devices:

a mechanical device, a sensing pin of the dead weight detecting that the dead weight is on/in the receiving structure, a magnetic device, a magnet arranged on/in the receiving structure and a magnetic sensor of the dead weight detecting the presence of said magnet, an optical device, an optical marker arranged on/in the receiving structure and an optical sensor of the dead weight detecting the presence of said optical marker, the third detection device is chosen among the following devices:

a mechanical device, a sensing pin of the dead weight detecting that the equipment is in contact with the dead weight, a magnetic device, a magnet arranged on the equipment and a magnetic sensor of the dead weight detecting the presence of said magnet, an optical device, an optical marker arranged on the equipment and an optical sensor of the dead weight detecting the presence of said optical marker, a circulating line measurement device giving the length of the line having circulated in both directions of circulation corresponding to the unwinding and to the retrieval of the line with respect to a determined fixed point, said fixed point being either in the dead weight, or in the line unwinding or retrieval apparatus of the receiving structure, a means for comparison with length thresholds making it possible to produce the detections of the third detection device as a function of said thresholds, the detection device is a complex device combining one or several of the described mechanical, magnetic, optical and measurement devices, the physical marker is a wharve of greater size than the diameter of the line, the wharve may be displaced along the line to modify the position of the fixed point according to the needs, the controllable line locking and unlocking arrangement, the controllable dead weight immobilization and release member, the first detection device, the second detection device are essentially mechanical, said first detection device being a sensing pin in the dead weight detecting the presence of a physical marker arranged at a fixed point on the line, said physical marker being a wharve of greater size than the diameter of the line, and the controllable line locking and unlocking arrangement includes a slider through which passes the line, said slider having a line passage with two regions of different sizes, a small size that lets only the line pass through and a great size that allows the passage of the physical marker, the sensing pin of the first detection device does not let the physical marker pass through, the second detection device is a sensing pin allowing the actuation of the slider, said sensing pin detecting whether or not the dead weight is on/in the receiving structure or in the catching device, in the case where the second detection device detects that this is not, the dead weight being hence not on/in the receiving structure or in the catching device, the slider is positioned so that the line passes through the small size passage letting only the line pass through and blocking the passage of the physical marker of the wharve type in order to lock the line in the dead weight, in the dead weight, the sensing pin of the first detection device is arranged on the equipment side and the slider is arranged on the receiving structure side along the path of the line in the dead weight, the dead weight includes a pulley and the catching device includes a pulley on which the trolling line is partially reeled, so that the trolling line has a substantially vertical path when the dead weight is in the catching device, the receiving structure includes a device for catching the dead weight, said catching device remaining integral with the receiving structure, the controllable dead weight immobilization and release member acting on at least one immobilization member of the capture device, and the second detection device of the controllable locking and unlocking arrangement is a sensing pin rod intended to detect the presence or the absence of the catching device in contact with the dead weight, the immobilization member of the capture device is a stud intended to enter into an orifice of the dead weight, the stud includes a head, the head has a mushroom shape, with a narrowed part under its head end, the controllable dead weight immobilization and release member includes a finger for locking the head of the catching device stud in the orifice of the dead weight, the controllable dead weight immobilization and release member includes a return means holding it in the configuration of catching device stud head locking, the locking finger of the controllable dead weight immobilization and release member may collapse at the time of introduction of the stud into the dead weight orifice, the controllable line locking and unlocking arrangement is controlled directly by the fact that the dead weight is or not on or in the receiving structure or on or in the catching device, the controllable immobilization and release member is controlled directly by the fact that the physical marker is arrived or not in the dead weight.

The invention also relates to a dead weight for a system of dead weight and equipment on a trolling line, in which system at the operational state, said equipment and said dead weight having been launched by unwinding of the trolling line, we find in water, successively: the equipment, a first portion of line of a first determined length, the dead weight, a second portion of line of a second determined length and a receiving structure, and wherein, at the rest state of the system, said equipment, said dead weight and said line are on or in the receiving structure after a retrieval of the line on or in the receiving structure, the dead weight is specially configured for the system of the invention and it includes:

an essentially mechanical, controllable line locking and unlocking arrangement, an essentially mechanical, controllable dead weight immobilization and release member, an essentially mechanical, first detection device making it possible to detect whether or not the equipment has moved away to a determined distance from the dead weight corresponding to the length of the first line portion, an essentially mechanical, second detection device making it possible to detect whether or not the dead weight is on or in the receiving structure, said first detection device being a sensing pin in the dead weight detecting the presence of a physical marker arranged at a fixed point on the line, said physical marker being a wharve of greater size than the diameter of the line, and the controllable line locking and unlocking arrangement includes a slider through which passes the line, said slider having a line passage with two regions of different sizes, a small size that lets only the line pass through and a great size that allows the passage of the physical marker.

The dead weight may come in all the technical possibilities possibly combined with the described variants.

The invention also relates to a dead weight catching device for a system of dead weight and equipment on a trolling line, as specially configured for the system of the invention, said catching device including a stud with a head intended to come and lock into a locking finger orifice of a dead weight of the system. The catching device may come in all the technical possibilities possibly combined with the described variants. In particular, it is intended to allow the hanging of the dead weight at least at the time of launch and during the retrieval of said dead weight. In a variant, at the rest state of the system, the dead weight remains hanged to the catching device. Preferably, at the rest state of the system, the dead weight is placed on/in the receiving structure for a better stabilization.

The invention also relates to a method of implementation of a system of dead weight and equipment on a trolling line and allowing the launch and the retrieval from one/on or in a receiving structure, of a piece of equipment and a dead weight linked to a trolling line, in which system at the operational state, said equipment and said dead weight having been launched by unreeling of the trolling line, we find in water, successively: the equipment, a first portion of line of a first determined length, the dead weight, a second portion of line of a second determined length and a receiving structure, and wherein, at the rest state, said equipment, said dead weight and said line are on or in the receiving structure after a retrieval of the line on or in the receiving structure, wherein a system according to the invention is implemented, and, in case of an order to launch from a rest state, the launch of the equipment is caused and the trolling line is unreeled until obtaining the first determined length of the first line portion, the dead weight being then automatically launched by the following means that are implemented:

an essentially mechanical, controllable arrangement for locking and unlocking the line with respect to the dead weight, an essentially mechanical, controllable dead weight immobilization and release member, an essentially mechanical, first detection device making it possible to detect whether or not the equipment has moved away to a determined distance from the dead weight corresponding to the length of the first line portion, an essentially mechanical, second detection device making it possible to detect whether or not the dead weight is on or in the receiving structure.

The method may come in various modes based on the described procedures.

BRIEF DESCRIPTION OF THE DRAWINGS

The present invention, without being limited thereby, will now be exemplified with the following description of embodiments and implementations, in relation with.

DETAILED DESCRIPTION OF THE PREFERRED EMBODIMENTS

The example that is given hereinafter relates to a barge floating on the sea or on soft water, which includes the system of the invention. It will be understood, from the reading of the following description, that the system in question can be used on any or in any suitable floating or submerged support: for example ship, canal barge, submarine, machine navigating on surface, between two waters or rolling on the bottom, whether it is on a bridge or in a hold/inside the machine. The receiving structure is caused to advance on or in water and the launched equipment and dead weight, which are linked by the trolling line, will hence extend rearward the receiving structure over a certain distance.

The system implements a control means that is a control apparel allowing activating the operation of the members required for the launch, unwinding, retrieval . . . and it hence allows controlling the corresponding functions. This apparel may, in a simple embodiment, consist in one or several control panels with buttons for controlling each of the members with or without electronic aid/control, the aid being for example a stroke-end control for a particular member. This equipment may, in an evolved embodiment, be a computer device managing the commands of each of the members by controls on the different members. Other embodiments between the two preceding ones are also possible, associating automated commands for certain of the members and non-automated/manual, possibly controlled, commands for the others. Furthermore, certain of these controlled operations are under the dependency of another controlled operation in order to automatize certain actions: for example, the command of the locking configuration of the locking and unlocking arrangement results from the fact that the dead weight launch command has been performed. Certain commands are hence secondary to an initial/primary command and are obtained by means for detecting the execution of the initial command, the second detection device for the above example. In practice, the locking and unlocking arrangement and the immobilization and release member are of the secondary command type, thanks to means for detecting the execution of an initial/primary command.

Figure 1:
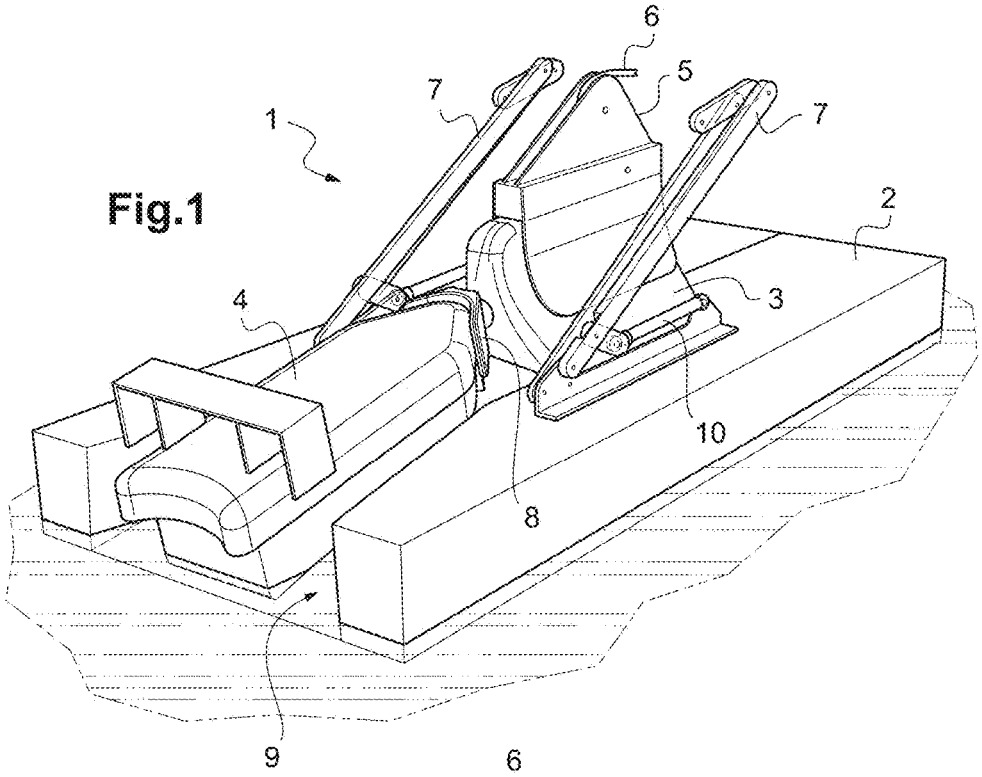
FIG. 1, which shows a perspective view of a system according to the invention at the rest state, with a floating receiving structure, onto which have been retrieved a dead weight, a piece of equipment and the trolling line to which these two latter elements are fastened/linked, FIG. 2, which shows the system of FIG. 1, at the beginning of launch of the equipment, the dead weight and the trolling line, FIG. 3, which shows the system of FIG. 1, with the following of the launch, due to the unreeling/unwinding of the trolling line, the equipment moving away from the dead weight still integral with the receiving structure, the line being unlocked from the dead weight and being able to slide with respect to said dead weight to which it is fastened/linked, FIG. 4, which shows the system of FIG. 1, with the further following of the launch, the equipment and the dead weight moving away from the receiving structure, due to the unreeling/unwinding of the trolling line that is continued and the locking of the line in the dead weight, FIG. 5, which shows a longitudinal sectional view of the dead weight and of a dead weight catching device of the receiving structure, the controllable dead weight immobilization and release member being in a dead weight immobilization configuration, the system being at a beginning of launch of the equipment, that has already moved away from the dead weight by unreeling/unwinding of the trolling line that slides through the dead weight, a wharve fixed on the line moving closer to the dead weight, FIG. 6, which shows a longitudinal sectional view of the dead weight and of the dead weight catching device of FIG. 5, the following of the launch having brought the wharve of the line in the dead weight to operate in release the controllable dead weight immobilization and release member.

The system 1 of FIG. 1 is at the rest state: the equipment 4 and dead weight 3 are on the bridge of a floating receiving structure 2, the trolling line 6 having been retrieved/rewound on the receiving structure 2. The trolling line 6 may be of any type: simple traction/dragging line, for example metallic or synthetic, or a mixed line both for traction/dragging and for communication and/or supply for data exchange and/or supply between the receiving structure and the equipment, or even the dead weight in case where the latter would include electronic devices.

The equipment 4 and the dead weight 3 are fastened/linked to the trolling line 6: for the equipment 4 in a fixed way and preferably at the free end, on the opposite side with respect to a not-shown line reeling/unreeling winch. The winch is fixed to the receiving structure 2, on the platform thereof or on a crane or a gantry crane. For the dead weight 3, the fastening of the trolling line 6 to the dead weight 3 has two states: locking and unlocking, thanks to a controllable locking and unlocking arrangement. In the locking configuration of the controllable locking and unlocking arrangement, the line 6 is immobilized with respect to the dead weight 3: the dead weight will hence move away from or closer to the receiving structure 2 as a function of the launch/unwinding or of the retrieval/winding of the line. In the unlocking configuration of the controllable locking and unlocking arrangement, the line 6 becomes free to slide with respect to the dead weight 3, the line however remaining fastened/linked to the dead weight, which corresponds to the equivalent fact that the dead weight may move freely along the line.

At the state rest of the system, the equipment 4 is preferably held on an inclined plane 9 of the receiving structure 2 by holding means (not shown) that avoid the untimely displacements of the equipment 4 during the movements of the receiving structure 2. The equipment holding means are removable to allow the launch. The inclined plane 9 forms a water access ramp on which the receiving structure 2 floats.

The receiving structure 2 may, more generally, be a ship part or other, or be, preferably, a prefabricated module, that has been fixed on or in a ship part or other. The receiving structure includes in this example a launching gantry crane 7 partially shown in FIG. 1 and operated by actuators, which are herein hydraulic jacks 10. In variants, one/several rolling carriages remaining integral with the receiving structure are provided for the equipment and/or dead weight launch and retrieval operations, rather than lifting one or both during these operations. This has for advantage to avoid that there is a hanged object (the equipment and/or the dead weight) that may pendulate as a function of the movements of the receiving structure during these operations. It may be provided to pick the carriage(s) back once the launch finished in order to avoid that they stay in water. Still simpler, it may be provided wheel-type rolling means under the equipment and/or the dead weight and one/several guiding and holding rails along the inclined plane, in particular a grooved rail for receiving a mushroom axis of the equipment and/or the dead weight.

In the example shown, a dead weight catching device 5 is fastened to the gantry crane. The catching device 5 remains all the time integral with the receiving structure 2, more precisely the gantry crane 7, and does not move away therefrom. At the rest state, the dead weight 3 is immobilized by the catching device 5 but it will be seen that the dead weight may be released from the catching device. In this example, the dead weight 3 is placed on the receiving structure and the catching device 5 immobilizing it comes and covers it partially to ensure a better holding. The line 6 passes through the catching device and the dead weight 3. The equipment 4 is practically in contact with the dead weight 3 and means of complementary shapes are provided in this contact area with an equipment docking guide 8. The trolling line passes through the docking guide 8 as will be seen hereinafter.

Figure 2:
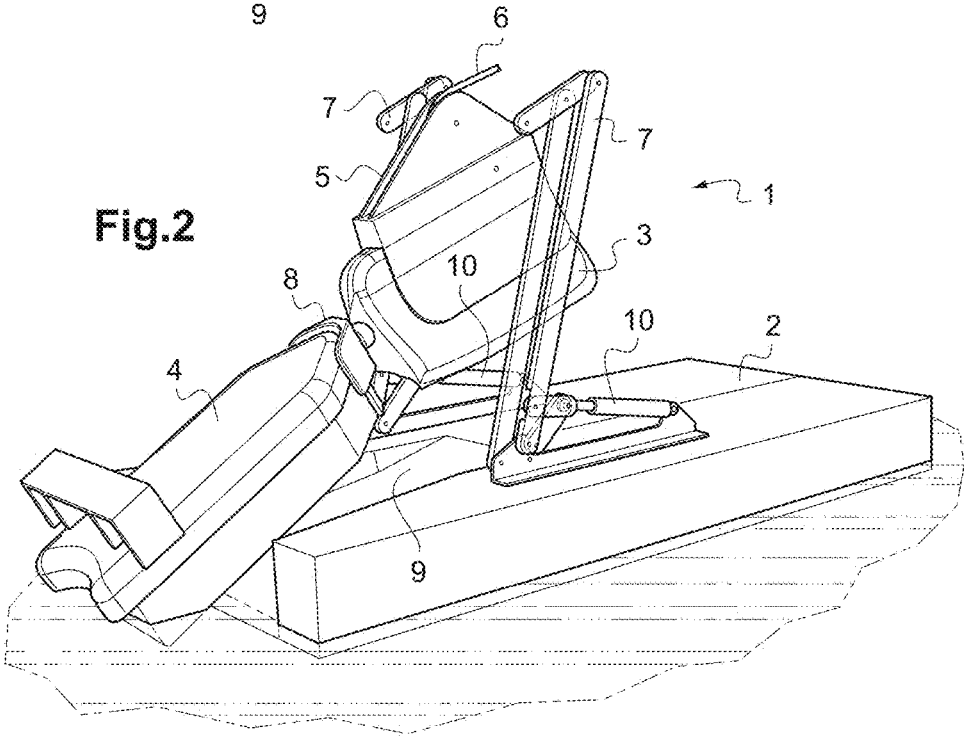

In FIG. 2, the launch of the equipment 4, the dead weight 3 and the trolling line has begun by lifting of the catching device 5 by the gantry crane 7, which lifts the dead weight 3 immobilized by/in the catching device 5 and also lifts, at least in part, the equipment 4 due to the fact that the latter is fixed to the trolling line that is still tightened and passes through the dead weight.

Figure 3:
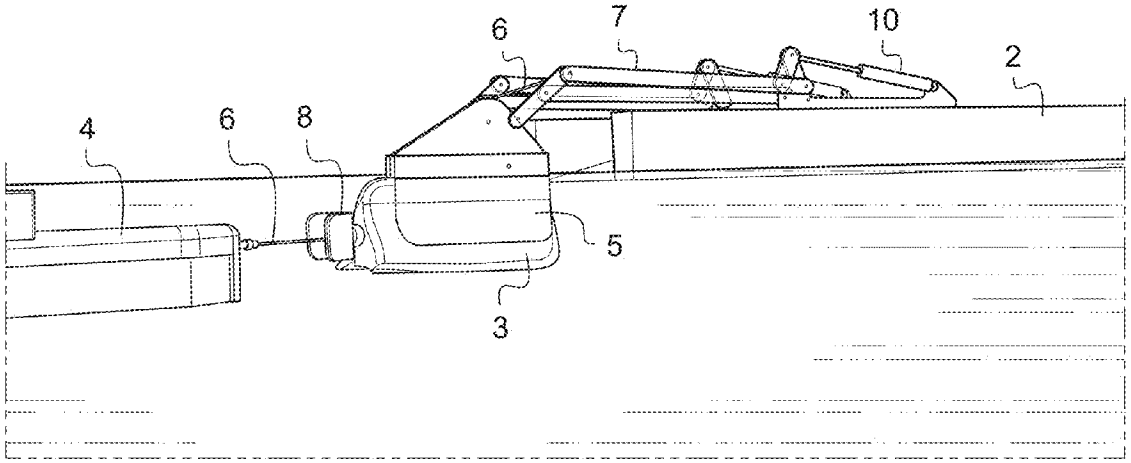

In FIG. 3, the gantry crane is completely extended to bring in water the equipment and the dead weight still immobilized by/in the catching device 5. Due to the unreeling of the line 6 and the fact that the latter is free to slide with respect to the dead weight 3, the equipment begins to move away from the dead weight 3 and from the receiving structure 2 and it can be seen the line 6 tightened between the equipment 4 and the exit of the line from the docking guide 8.

Figure 4:
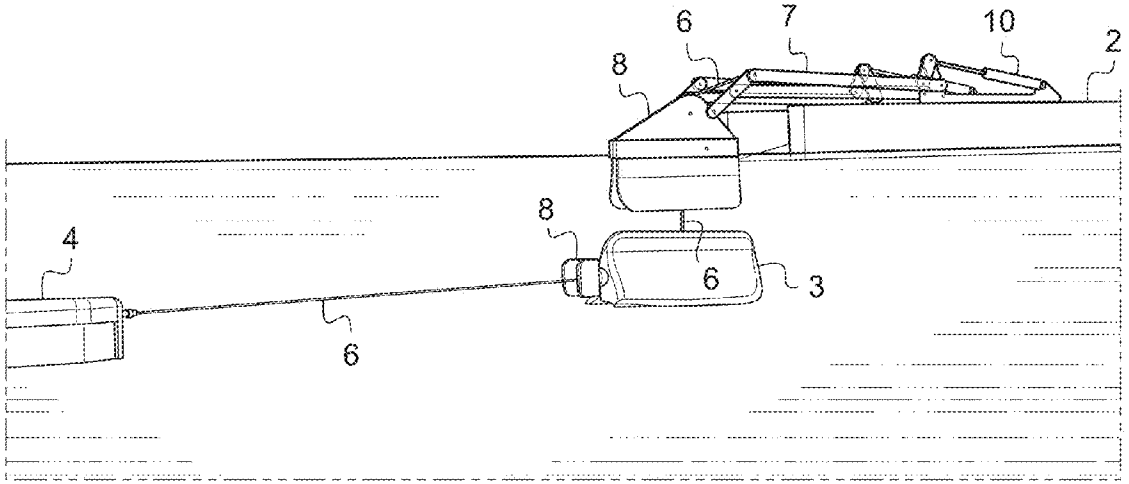

FIG. 4, the equipment 4 has moved away from the dead weight and hence from the receiving structure by a sufficient determined distance and the dead weight has then been released from the catching device 5. During this release, the controllable locking and unlocking arrangement, which was up to now in the unlocking configuration (the line being hence free to slide in the dead weight), passes to the locking state, immobilizing the line 6 in the dead weight, the dead weight 3 will hence now follow the unreeling (or the reeling in case of retrieval) of the line out of (into) the receiving structure 2 and move away therefrom (closer thereto). In FIG. 4, the dead weight just begins to move away and the length of the line 6 between the dead weight 3 and the catching device 5 (or the receiving structure 2), is still small. The line may still be unreeled if it is desired that the dead weight moves further away from the receiving structure. Once the unreeling finished, the system being then at the operational state, the catching device 5 can then, if desired, be picked back on the receiving structure.

In the example shown, the controllable locking and unlocking arrangement is a locking and unlocking device that is controlled as a function of detections by a second detection device, also called second detector, making it possible to detect whether or not the dead weight is in or on the receiving structure. As for it, the first detection device, also called the first detector, makes it possible to detect whether or not the equipment has moved away by a determined distance from the dead weight and, in particular, it makes it possible to determine the moment of the dead weight launch. The controllable immobilization and release member is a device for immobilizing and releasing the dead weight on or in and out of the receiving structure, the control thereof being under the dependency of the first detector. Finally, the third detection device, also called third detector, makes it possible to detect if the equipment has sufficiently moved closer to the dead weight for docking.

Hence, in a first time of the launch, the trolling line is free to slide through the dead weight until a detection device detects that the equipment 4 has moved away to a determined distance from the dead weight 3, or equivalently from the receiving structure 2 (the dead weight being still immobilized to the receiving structure) to then control the locking and unlocking arrangement to the locking configuration and to launch said dead weight. Then, the line being locked in the dead weight, the dead weight follows the evolutions of unreeling (=launch) and reeling (=retrieval) of the line.

For the retrieval of the equipment 4, the dead weight 5 and the trolling line 6, in a first time, the line is reeled/retrieved on the receiving structure, which allows moving the dead weight closer to its catching device 5, given that the line is locked in the dead weight. Once the dead weight has reached its catching device 5, the line is unlocked from the dead weight while remaining integral with the dead weight and the line may again slide in the dead weight. There is also an immobilization of the dead weight in the catching device 5. It is hence possible to continue retrieving/reeling the line on the receiving structure to bring the equipment back thereon in order to place the system in the rest state.

It is understood that the expression "fastening/integral" between the trolling line and the dead weight means that the dead weight is linked to the line and is held at a predetermined distance from the line along the line, herein a distance reduced to zero because the line passes through the dead weight, and that the fact that the line can slide or not with respect to the dead weight relates to a locking or unlocking state independent of the fastening itself. In practice, the line, instead of passing in/through the dead weight could pass on one of its sides or even at a certain distance and a link of fixed length being then provided between both and the locking-unlocking arrangement being then at the end of the link on the trolling line side.

The controllable arrangement for locking and unlocking the trolling line and the controllable member for immobilizing and releasing the dead weight on/from the receiving structure will now be described more in details.

Figure 5:
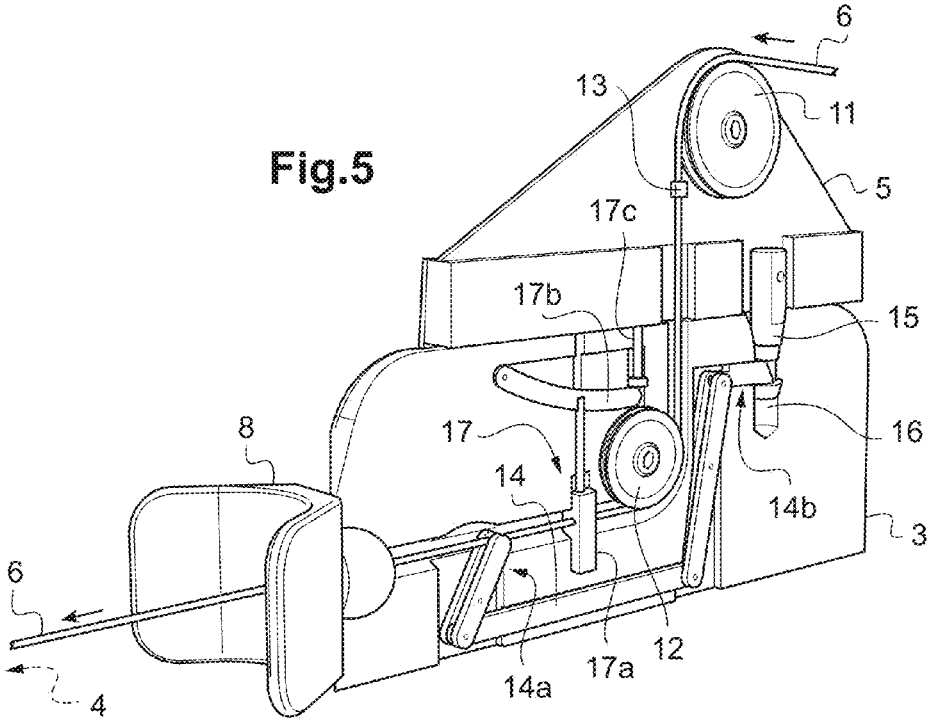

In FIG. 5, the dead weight 3 is still immobilized in the catching device 5 and the trolling line 6 has been unreeled practically up to reach the provided distance between the equipment 4 (not visible and symbolized on the left by the arrow in dotted lines of the reference 4) and the dead weight to perform the releasing of the dead weight and the locking of the line in the dead weight.

The line 6 in course of unreeling/unwinding (arrow oriented towards the left above the line) of the receiving structure winch firstly passes through the catching device 5 by passing on a first pulley 11. The line then passes through the dead weight 3 by passing on a second pulley 12 to exit through the docking guide 8. As can be seen, the docking guide 8 is mounted articulated through a knuckle on the dead weight 3. On its way through the dead weight, the line 6 passes through a locking slider 17*a* of the controllable line locking and unlocking arrangement 17. In the control configuration shown, the line 6 is free to slide through the dead weight 3. The controllable line locking and unlocking arrangement 17 is actuated by a sensing pin rod 17*c* intended to detect the presence or the absence of the catching device 5 in contact with the dead weight 3. The sensing pin rod 17*c* operates a control arm 17*b* acting on the locking slider 17*a*.

The dead weight also includes the controllable dead weight immobilization and release member 14 that has a control sensing pin 14 as well as a finger 14*b* for locking the head of a stud 15, the stud 15 being itself integral with the catching device 5. The stud 15 of the catching device 5 enters into an orifice 16 of the dead weight 3 when the dead weight is immobilized in the catching device and as shown in FIG. 5. This control sensing pin 14*a* forms a detection device making it possible to detect if the equipment has moved away to a distance from the dead weight that corresponds to that wanted for the operational state that is desired to be reached by the launch. For that purpose, a mechanical physical marker, in the form of a wharve 13, is fixed/immobilized on the line 6 and, in FIG. 5, this wharve 13 reaches the dead weight. The wharve 13 has a greater diameter than that of the line 6 to which it is fixed.

It is understood that, in the case where a catching device would not be implemented, the stud would then be integral with the receiving structure and the sensing pin 14*a* of the controllable immobilization and release member 14 would then be intended to detect whether or not the dead body is on/in the receiving structure. In other variants, more than one stud may be implemented between the catching device or the receiving structure and the dead weight, wherein each of the studs can be locked or not in the dead weight, at least one of the studs being locked in particular for reasons of security and stability of the dead weight on/in the receiving structure or the catching device, in particular if, as shown, the dead weight is hanged at certain steps of the launch or the retrieval.

The controllable member 14 for immobilizing and releasing the dead weight on/from the receiving structure is hence controlled directly by the wharve 13.

The controllable line locking and unlocking arrangement 17 is hence controlled directly by the relative moving closer to each other or away from each other between the dead weight 3 and the catching device 5, and hence indirectly by the wharve 13. It is to be understood that it is possible, in a variant, to implement a direct command of the locking slider 17*a* by the wharve.

The dead weight hence includes a pulley 12 and the catching device a pulley 11 onto which is partially reeled the trolling line 6 so that the trolling line has a substantially vertical path when the dead weight is in the catching device or, at the very least, when it is in course of launch or retrieval (cf. FIGS. 3, 4).

Figure 10:
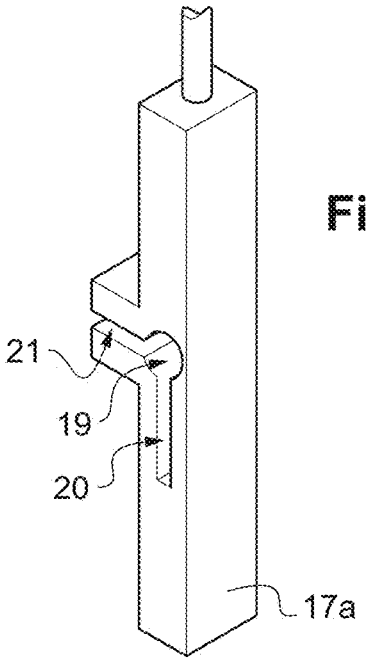

In the position of the locking slider 17*a* shown in FIG. 5, the line 6 passes through said slider in a great-size channel 19, through which the wharve 13 will be able to pass. FIG. 10 shows an enlargement of the locking slider 17*a* and it can be seen that the great-size channel 19, herein of great diameter, as well as a smaller-size channel 20, herein of small thickness, and through which the line 6 can circulate but not the wharve 13. The great-size 19 and small-size 20 channels are in continuity to each other so that the line can pass from one to the other during the sliding of the locking slider 17*a*. It is also noted the presence of an insertion channel 21 of small size allowing the passage of the line during the installation of the slider in the dead weight whereas the line 6 is already in place and in order to avoid having to pass the line in the locking slider 17*a* starting from a free end of the line. Moreover, it may be provided the implementation of several wharves of different sizes on the line and of interchangeable sliders to lock such or such wharve as a function of the needs.

Figure 6:
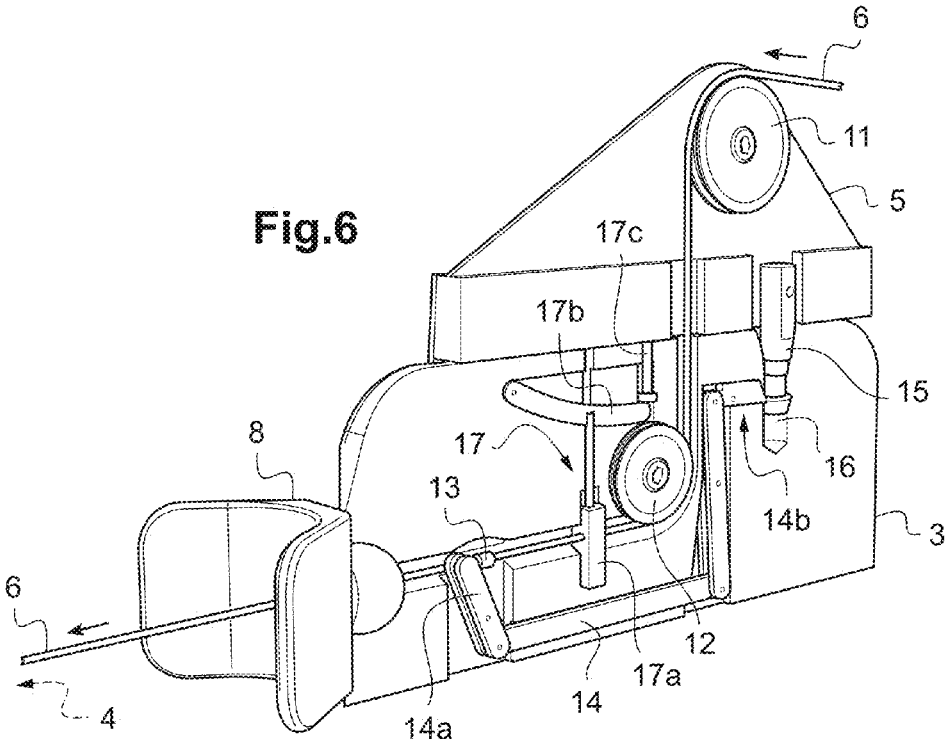

In FIG. 6, the wharve 13 that has moved in the dead weight due to the launch/unwinding of the line 6 has just controlled the controllable member 14 for immobilizing and releasing the dead weight 3 by making it switch to the release configuration. The control sensing pin 14*a* has detected the presence of the wharve 13 that has caused the tilting thereof, which has caused the removing of the locking finger 14*b* and the release of the stud 15. It is to be noted that the sensing pin 14*a* intended to detect the presence of the wharve 13 is also a means that prevents the passage of the wharve, which hence cannot go further forward.

Figure 7:
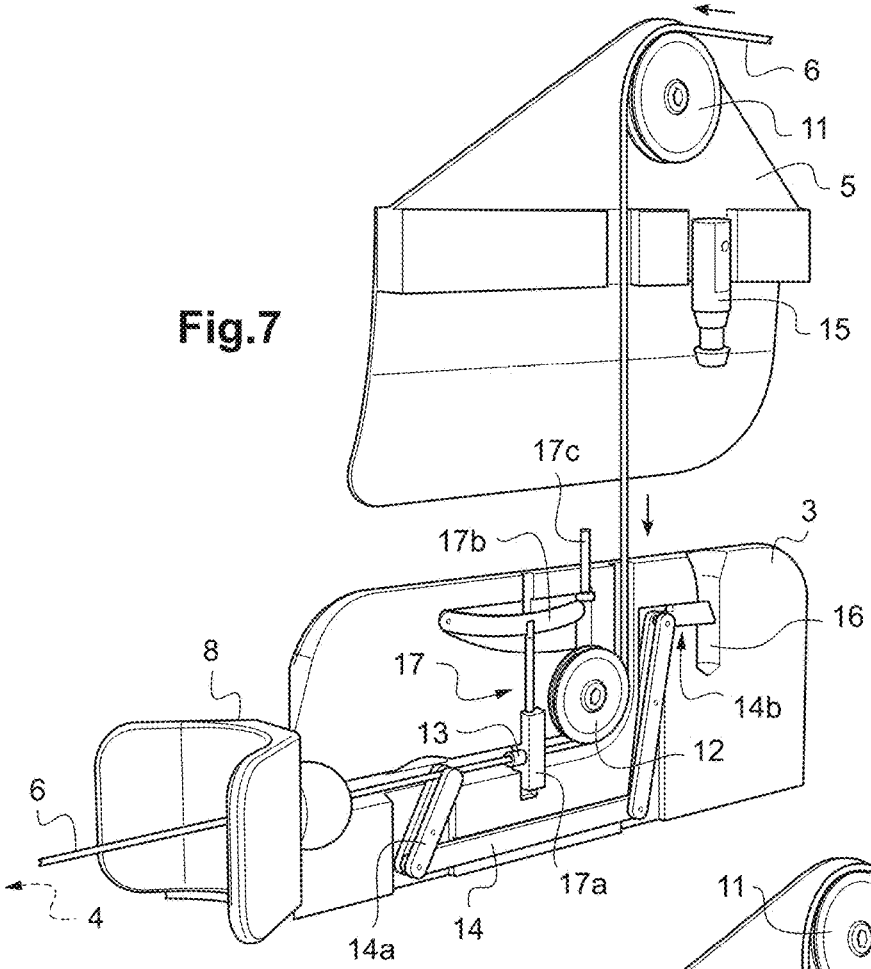
FIG. 7, which shows a longitudinal sectional view of the dead weight and of the dead weight catching device of FIG. 5, the following of the launch having caused the release of the dead weight that moves away from the receiving structure and the locking in translation/sliding of the line with respect to the dead weight, the wharve being caught in the dead weight, FIG. 8, which shows a longitudinal sectional view of the dead weight and of the dead weight catching device towards the end of the dead weight retrieval by retrieval/re-reeling of the line, the wharve being still caught in the dead weight, FIG. 9, which shows a longitudinal sectional view of the dead weight and of the dead weight catching device of FIG. 8, at the end of the retrieval of the dead weight, the wharve being released from the dead weight and the equipment continuing to be retrieved by continuation of the retrieval/re-reeling of the line that can now slide with respect to the dead weight, and FIG. 10, which shows a trolling line locking slider of the controllable line locking/unlocking arrangement installed in the dead weight.

In FIG. 7, the dead weight 3 begins to move away from the catching device 5 due to the release of the dead weight 3 from the catching device 5 and to the fact that the line 6 is now locked in the dead weight 3. This locking is due to the fact that the slider 17*a* of the controllable locking and unlocking arrangement 17 has moved and that the line 6 now passes through said slider at the smaller-size channel 20, which does not let the wharve 13 pass through. The wharve 13 is hence now locked in the dead weight between the sensing pin 14*a* and the so-displaced slider 17*a*. The unwinding/launch of the trolling line by the receiving structure 2 will hence make so that the dead weight 3 and hence the equipment 4 will move away from the receiving structure until the operational state is obtained.

It is understood that, in the context of the invention, the words unrolling, unreeling, unwinding or launch for the trolling line are equivalent and correspond to a controlled release of the trolling line from the receiving structure after an order to launch for the system. Conversely, the words retrieval, winding, reeling correspond to a controlled return of the trolling line towards and by the receiving structure after an order to retrieve for the system.

It may be observed that the controllable locking and unlocking arrangement 17 includes a return means that places it by default, i.e. when the dead weight 3 is separated from the catching device 5, in the locking configuration. As soon and as long as the dead weight is received/on/in the receiving structure, herein in the catching device of the receiving structure, the locking and unlocking arrangement switches to the unlocking state so that the trolling line can slide through the dead weight.

It is also observed that the controllable immobilization and release member 14 that is no longer stressed by the wharve 13 has switched back to a configuration in which the locking finger 14*b* is in the orifice 16 of the dead weight 3. The controllable immobilization and release member 14 hence includes a means for returning it to the latter configuration. The controllable immobilization and release member 14 is hence also configured, bevelled end of the finger 14*b* and counter-bevelled head of stud 15, so as to allow the passive installation of the stud 15 in the orifice 16 during the retrieval, the finger 14*b* collapsing during the introduction of the stud head and then coming and locking it once the stud completely introduced in the orifice 16.

In this example, the controllable locking and unlocking arrangement 17 is controlled directly by the fact that the dead weight 3 is or not in the catching device 5 and hence indirectly by the fact that the physical marker, herein the wharve 13, has arrived in the dead weight 3. The controllable immobilization and release member 14 is itself directly controlled by the fact that the physical marker, herein the wharve 13, has arrived in the dead weight 3. The commands are hence in cascade. It is understood that it is possible to implement means so that the two commands in question are directly controlled by the fact that the physical marker, herein the wharve 13, has arrived in the dead weight 3. The controllable means behave as automated control means.

Figure 8:
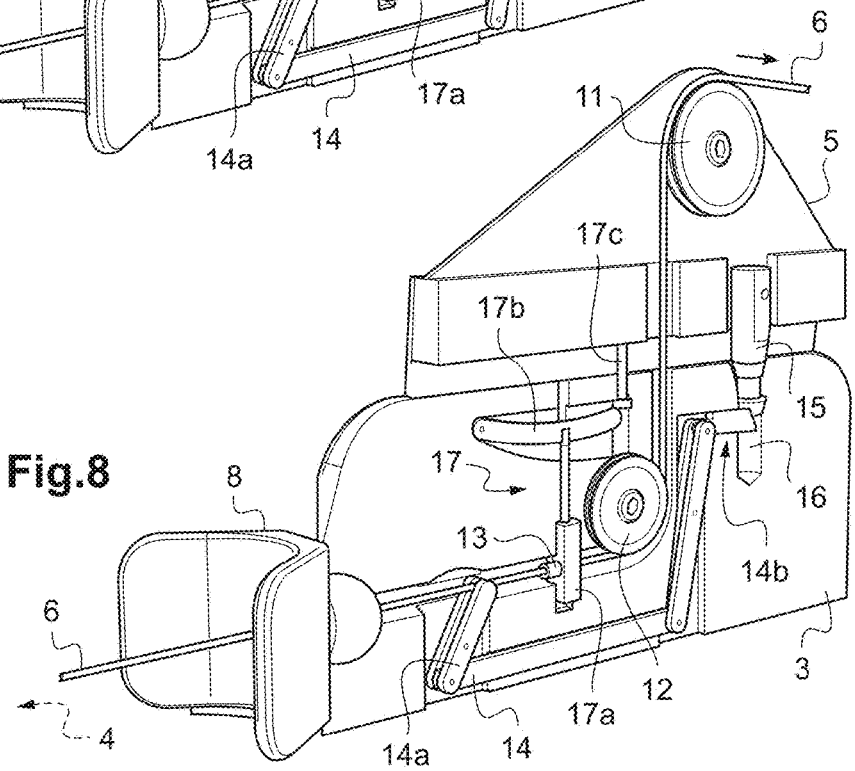
Figure 9:
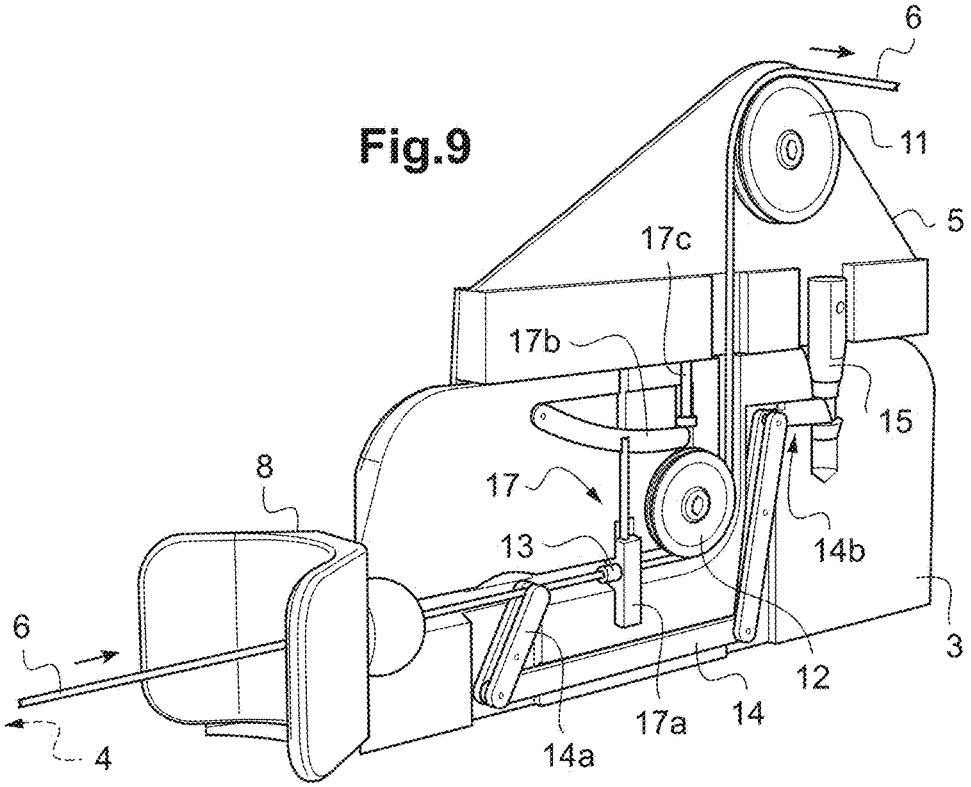

In FIG. 8, an order to retrieve has been given by to the system control means and the trolling line 6 has begun to be retrieved/rewound on/in the receiving structure. Due to the line 6 is locked in the dead weight, the dead weight 3 has moved closer to the catching device 5 and the stud 15 of the catching device begins to be introduced into the orifice 16 of the dead weight 3. The locking finger 14*b* will temporarily collapse during the passage of the head of the stud 15 that forces the return means of the controllable immobilization and release member 14. The sensing pin rod 17*c* will begin to be stressed by the presence of the catching device 5. However, this is only when the dead weight is well in the catching device, as shown in FIG. 8, that the slider will be able to move so that the controllable locking and unlocking arrangement 17 switches to the configuration of line wharve unlocking: the wharve will be able to pass back through the slider 17*a*.

The following of the steps of retrieval is continued in the reverse order with respect to that of the launch to finally lead to the rest state of the system.

More generally, the dead weight includes a controllable line locking and unlocking arrangement making it possible, in the locking configuration, to immobilize the line to the dead weight and, in the unlocking configuration, to permit the line to slide with respect to the dead weight, the line remaining integral with the dead weight but slidingly mobile. Moreover, considering that at the operational state, we found in water, successively: the equipment, a first portion of line of a first determined length, the dead weight, a second portion of line of a second determined length and the receiving structure, the system includes detection devices making it possible to detect that:

the equipment has moved away or not to a determined distance from the dead weight corresponding to the length of the first portion of line, the dead weight is or not on or in the receiving structure, the equipment has or not moved closer to a determined distance with respect to the dead weight, said determined distance being lower than the length of the first portion of line and corresponding to a reduced length of line between the equipment and the dead weight allowing the equipment to be handled on or in the receiving structure. The system further includes a control means configured so as, on the one hand, in case of an order to launch, the equipment, the dead weight and the line being on the receiving structure at the rest state:

at a step 1L of the launch, to control the locking and unlocking arrangement to the unlocking configuration if it wasn't in it, at a step 2L, to launch the equipment out of the receiving structure by unwinding the line, at a step 3L, when the detection device detects that the equipment has moved away to the determined distance from the dead weight, to hence launch said dead weight and control the locking and unlocking arrangement to the locking configuration, while continuing unreeling the line, the line being then immobilized to the dead weight, at a step 4L, to stop the unreeling of the line when the unwinding of the line has allowed obtaining the second portion of line, and on the other hand, in case of an order to retrieve, the system being at the operational state:

at a step 1R of the retrieval, to retrieve the line on the receiving structure, at a step 2R, when the detection device detects that the dead weight has been retrieved on or in the receiving structure, to then control the locking and unlocking arrangement to the unlocking configuration and to continue retrieving the line on the receiving structure, the line being then able to slide with respect to the dead weight, at a step 3R, when the detection device detects that the equipment has moved closer, to the determined distance from the dead weight, to then handle the equipment on the receiving structure and to stop the retrieval of the line.

It is understood that the means described in relation with the Figures are an exemplary embodiment and that it is possible to implement other physical means producing the same automated functions of locking/unlocking and immobilization/release. It is the same for the detection devices. Hence, means controlled directly and indirectly by the wharve or another type of marker on the trolling line may be implemented. Moreover, if preferably, the means implemented in the dead weight are essentially mechanical in order to better resist to an environment that may be aggressive (saline medium, movements, shocks . . . ), the invention may implement mixed and/or electric, pneumatic, hydraulic, electronic means. More generally, the global control means of the system further include to the preferably mechanical means of the dead weight: electronic means to ensure a correct sequencing of the steps of operation of the system as a function of the order to launch and to retrieve to be executed. Hence, the system may be totally autonomous with no human intervention other than giving the desired order to launch or to retrieve. The receiving structure may hence include, according to the needs, a source of energy, electronic means, a propeller, a rudder, a radio remote device, sensors for verifying the execution of the steps and/or any other useful element.

The invention claimed is:

1. A method of implementing a system (1) of a dead weight (3) and equipment (4) on a trolling line (6), where the system is configured for launch and retrieval from a receiving structure (2) of a machine navigating on or in water, the trolling line (6) being continuous and integral with the equipment (4), the dead weight (3) and the receiving structure (2), and the trolling line (6) including a first end on the equipment side and a second end on the receiving structure side, the equipment being fixed in a fixed point of the line, the line on the second end side being fixed to the receiving structure in a point that is mobile over a length of the trolling line (6) so as to allow the launch and the retrieval of the line, of the equipment, and of the dead weight, wherein, in an operational state of the system, said equipment and said dead weight having been launched by unreeling of the trolling line, the equipment, the dead weight, and the receiving structure are arranged successively along the line (6) as follows: the equipment, a first portion of line of a first determined length, the dead weight, a second portion of line of a second determined length and the receiving structure, and wherein, in a rest state of the system, said equipment, said dead weight and said line are arranged on or in the receiving structure after a retrieval of the line on or in the receiving structure, the method comprising:

providing a controllable arrangement (17) for locking and unlocking the dead weight (3) on the line, said controllable arrangement (17), in a first locking configuration permitting an immobilization of the line (6) with respect to the dead weight (3) and, in a second unlocking configuration of the controllable arrangement (17), the line (6) is free to slide with respect to the dead weight (3);

detecting, via a first detection device (14*a*), whether or not the equipment (4) has moved away to a determined distance from the dead weight (3) corresponding to the first determined length of the first portion of line; and upon receiving an order to launch from the rest state of the system, causing, via a control means, the following sub-steps to be successively carried out:

a step of equipment launch (2L), including launching the equipment out of the receiving structure (2) by unwinding the line (6), a step of dead weight launch (3L) including, upon the first detection device (14*a*) detecting that the equipment has moved away to the first determined distance from the dead weight (3), causing said dead weight (3) to be launched and controlling the controllable arrangement (17) to enter the locking configuration while continuing to unreel the line (6), the line being then immobilized with respect to the dead weight, and a step of unwinding stop (4L) where, upon the unwinding of the line obtaining the second determined length of the second line portion, stopping the unreeling of the line (6), wherein, in the unlocking configuration of the controllable arrangement (17), the line remains linked to the dead weight but is slidingly mobile with respect to said dead weight, wherein the method further includes, via a second detection device (17*c*), detecting whether or not the dead weight (3) is any of on or in the receiving structure, and wherein, at the step of dead weight launch (3L), the control of the controllable arrangement (17) into the locking configuration results from detection by the second detection device (17*c*) that the dead weight (3) is not any of on or in the receiving structure (2) after the launch of said dead weight.

2. The method according to claim 1, further comprising:

providing a third detection device that detects whether or not the equipment (4) has moved to a determined distance of docking of the dead weight (3), said determined distance of docking being shorter than the length of the first portion of line and corresponding to a reduced length of line between the equipment (4) and the dead weight (3), allowing the equipment to be handled on or in the receiving structure, and at the control means, upon receiving an order to retrieve and the system being in the operational state, the following sub-steps are successively carried out:

a step of line retrieval (1R), including partially retrieving the line (6) on the receiving structure (2), a step of dead weight retrieval (2R) where, upon the second detection device (17*c*) detecting that the dead weight has been retrieved on or in the receiving structure (2), causing the controllable arrangement (17) to enter the unlocking configuration and continuing to retrieve the line on the receiving structure, the line being able to slide with respect to the dead weight, and a step of equipment retrieval (3R) where, when the third detection device detects that the equipment (4) has moved to the determined distance of docking of the dead weight, causing the equipment (4) to be handled on the receiving structure and causing the reeling of the line (6) to stop.

3. The method according to claim 1, further comprising:

immobilizing and releasing, via a controllable member (14) the dead weight from the receiving structure so as, in an immobilization configuration, to lock the dead weight on or in the receiving structure (2) and, in a release configuration, to release the dead weight in order to allow the dead weight to leave the receiving structure;

upon receiving the order to launch, and upon detection by the first detection device (14*a*) that the equipment (4) has moved away to the first determined distance from the dead weight (3), causing, by way of the control means, the controllable member (14) to enter the release configuration so as to launch said dead weight, wherein the immobilization configuration is a configuration by default of the controllable member, the retrieval of the dead weight on or in the receiving structure causing by default the immobilization of the dead weight.

4. The method according to claim 1, wherein the first detection device is selected from the group consisting of:

a mechanical device, with a physical marker (13) arranged at a fixed point on the line and in such a position along the line that the first determined length of the first portion of line is between the equipment and said fixed point of the physical marker, the dead weight including a sensing pin (14*a*) that detects a presence of said physical marker, a magnetic device, with a magnet arranged at a fixed point on the line and in such a position along the line that the first determined length of the first portion of line is between the equipment and said fixed point of the magnet, the dead weight including a magnetic sensor that detects a presence of said magnet, an optical device, with an optical marker arranged at a fixed point on the line and in such a position along the line that the first determined length of the first portion of line is between the equipment and said fixed point of the optical marker, the dead weight including an optical sensor that detects a presence of said optical marker, and a circulating line measurement device that registers a length of the line having circulated in both directions of circulation corresponding to the unwinding and to the retrieval of the line with respect to a determined fixed point, said fixed point being either in the dead weight, or in the line unwinding or retrieval apparatus of the receiving structure, including a means for comparison of the registered length with length thresholds for producing the detections of the first detection device as a function of said thresholds.

5. The method according to claim 1, wherein the second detection device is selected from the group consisting of:

a mechanical device, the dead weight including a sensing pin (17*c*) that that interacts with the mechanical device to determine whether the dead weight is on or in the receiving structure, a magnetic device, the receiving structure including a magnet arranged on or in the receiving structure, and the magnetic device being located on the dead weight that detects a presence of said magnet, and an optical device, the receiving structure including an optical marker arranged on or in the receiving structure, and the optical device being located on the dead weight that detects a presence of said optical marker.

6. The method according to claim 3, wherein the controllable arrangement (17), the controllable member (14), the first detection device (14*a*), and the second detection device (17*c*) are each provided as mechanical devices, said first detection device (14*a*) being a sensing pin in the dead weight (3) that detects a presence of a physical marker arranged at a fixed point on the line, said physical marker being a wharve (13) of greater size than a diameter of the line, and wherein the controllable arrangement (17) includes a slider (17*a*) through which passes the line (6), said slider having a passage for the line (6) with two regions of different sizes, including a small size (20) that permits only the line pass through, and a great size (19) that allows the passage of the physical marker.

7. The method according to claim 6, wherein the receiving structure (2) includes a dead weight catching device (5), said catching device (5) remaining integral with the receiving structure (2), the controllable member (14) acting on at least one immobilization member of the catching device, and wherein the second detection device (17*c*) of the controllable arrangement (17) is a sensing pin rod (17*c*) that detects a presence or absence of the catching device in contact with the dead weight.

8. The method according to claim 6, wherein the controllable arrangement (17) is controlled directly by the fact that the dead weight (3) is or not on or in the receiving structure (2) or on or in the catching device (5), and wherein the controllable member (14) for immobilizing and releasing the dead weight is controlled directly by the first detection device (14*a*) and the fact that the physical marker is arrived or not in the dead weight (3).

9. A dead weight configured for use with equipment on a trolling line configured for launch and retrieval from a receiving structure (2) of a machine navigating on or in water, the trolling line having a first portion of line of a first determined length and a second portion of line of a second determined length, the dead weight comprising:

a mechanical, controllable line locking and unlocking arrangement (17);

a mechanical, controllable dead weight immobilization and release member (14);

a mechanical, first detection device (14*a*) that detects whether or not the equipment has moved away to a determined distance from the dead weight corresponding to the first length of the first line portion; and a mechanical, second detection device (17*c*) that detects whether or not the dead weight is on or in the receiving structure, said first detection device (14*a*) being a sensing pin in the dead weight detecting the presence of a physical marker arranged at a fixed point on the line (6), said physical marker being a wharve (13) of greater size than the diameter of the line, the controllable line locking and unlocking arrangement (17) including a slider (17*a*) through which passes the line (6), the slider having a line passage with two regions of different sizes, the two regions including a small size (20) that permits only the line to pass therethrough, and a great size (19) that permits the passage therethrough of the physical marker, the slider (17*a*) being in a first sliding position, wherein the line passes through the great size (19) region, when the second detection device detects that the dead weight is any of on or in the receiving structure, and the slider (17*a*) being in a second sliding position, wherein the line passes through the small size (20) region, when the second detection device detects that the dead weight is not any of on or in the receiving structure.

* * * * *